US012564877B2

(12) United States Patent
Motohashi et al.

(10) Patent No.: US 12,564,877 B2
(45) Date of Patent: Mar. 3, 2026

(54) CASTING MOLD

(71) Applicant: HONDA FOUNDRY CO., LTD., Kawagoe (JP)

(72) Inventors: Naohisa Motohashi, Kawagoe (JP); Tomoichiro Kariya, Kawagoe (JP)

(73) Assignee: Honda Foundry Co., Ltd., Saltama (JP)

( * ) Notice: Subject to any disclaimer, the term of this patent is extended or adjusted under 35 U.S.C. 154(b) by 0 days.

(21) Appl. No.: 18/834,260

(22) PCT Filed: Mar. 31, 2023

(86) PCT No.: PCT/JP2023/013453

§ 371 (c)(1),
(2) Date: Jul. 30, 2024

(87) PCT Pub. No.: WO2023/223688

PCT Pub. Date: Nov. 23, 2023

(65) Prior Publication Data

US 2025/0153238 A1 May 15, 2025

(30) Foreign Application Priority Data

May 19, 2022 (JP) ..... 2022-082010
Mar. 14, 2023 (JP) ..... 2023-039259

(51) Int. Cl.
*B22C 9/08* (2006.01)
*B22D 17/22* (2006.01)

(52) U.S. Cl.
CPC ..... *B22C 9/08* (2013.01); *B22D 17/22* (2013.01)

(58) Field of Classification Search
CPC ..... B22C 9/08; B22D 17/22; B22D 18/04
See application file for complete search history.

(56) References Cited

FOREIGN PATENT DOCUMENTS

| | | | |
|---|---|---|---|
| JP | S62-61359 U | | 4/1987 |
| JP | H09-225584 A | | 9/1997 |
| JP | 2009056503 A | * | 3/2009 |

* cited by examiner

*Primary Examiner* — Keith Walker
*Assistant Examiner* — Steven S Ha
(74) *Attorney, Agent, or Firm* — Carrier, Shende & Associates P.C.; Joseph P. Carrier; Fulchand P. Shende

(57) ABSTRACT

In a casting mold (20), a main runner (26) and branch runners (27) are disposed in a Y-shape, the branch runners (27) are disposed in a V-shape, and when a portion where molten metal that has passed through the main runner (26) hits and divides into the branch runners (27) is referred to as a V-shaped portion (29), a void (31) extending across a valley bottom of the V-shaped portion (29) and connecting inlets of the branch runners (27) is provided.

2 Claims, 8 Drawing Sheets

CASTING MOLD

TECHNICAL FIELD

The present invention relates to a multi-cavity casting mold.

BACKGROUND ART

Taking the example of a vehicle, steering components include a knuckle. The knuckle includes a left knuckle attached to a left wheel, and a right knuckle attached to a right wheel.

It is common practice to provide a cavity for a left knuckle and a cavity for a right knuckle in one casting mold, and cast the left knuckle and the right knuckle in one pouring. In such a manner, obtaining two or three or more products using one casting mold is referred to as multi-cavity molding.

Various casting molds designed for such multi-cavity molding have been proposed (for example, refer to Patent Document 1 (FIG. 5)).

Patent Document 1 will be described based on the following drawing.

FIG. 8 is an outline view of a casting casted by the conventional art.

A casting 100 includes a product portion 101 and a plan portion 111. Incidentally, a plan in casting technique is a term referring to the internal design of a casting mold; however, in the present specification, a non-product portion of a casting is referred to as a plan portion.

The product portion 101 includes a first product casting 102 and a second product casting 103.

The plan portion 111 includes a V-shaped plan portion 112.

The plan portion 111 is separated from the first product casting 102 and the second product casting 103 by a cutter referred to as a gate cutting machine. The separated plan portion 111 is collected and remelted.

Meanwhile, each of the first product casting 102 and the second product casting 103 is subjected to machining to become a product.

Generally, the casting mold is at a lower temperature than molten metal. After pouring, the molten metal cools and solidifies in the casting mold. When the casting mold includes coolant passages, the cooling and solidification of the molten metal is accelerated.

After pouring, the product portion 101 cools, and the plan portion 111 cools with a delay. Further, a central portion 113 of the plan portion 111 cools with the greatest delay. As a result, the central portion 113 of the plan portion 111 solidifies with the greatest delay.

The central portion 113 is solidified, and then the casting mold is opened. When the casting mold includes a fixed mold and a movable mold, the casting 100 is separated from the fixed mold in a state where the casting 100 is attached to the movable mold. Next, the casting 100 is removed from the movable mold by a removal robot. The above process is the standard casting process.

By the way, in recent years, there has been a demand for an improvement in productivity, and as part of the effort, shortening the casting cycle time has been considered.

In order to shorten the casting cycle time, the inventors have attempted to open the casting mold and to remove the casting 100 from the casting mold in a stage where the central portion 113 of the plan portion 111 is unsolidified.

Thereupon, the casting 100 cracks, a part of the casting 100 remains in the fixed mold, and the remainder of the casting 100 is joined to the movable mold. The remainder is removed by the removal robot.

Meanwhile, the part of the casting 100 remaining in the fixed mold needs to be separately removed, and it takes time for this process, so that shortening the casting cycle time cannot be achieved.

However, as a demand for an improvement in productivity, there is a demand for a technique capable of achieving shortening of the casting cycle time.

CITATION LIST

Patent Document

Patent Document 1: Japanese Unexamined Patent Publication No. 2009-56503

SUMMARY OF THE INVENTION

Problem to be Solved by the Invention

A task of the invention is to provide a technique capable of achieving shortening of a casting cycle time in a multi-cavity casting mold including a V-shaped portion at a plan portion.

Means for Solving Problem

The invention according to a first aspect is a casting mold that is a multi-cavity casting mold, the casting mold including: a gate; a main runner extending from the gate; a plurality of branch runners branching off from the main runner; and cavities provided at respective ends of the branch runners, in which in a cross-section of the casting mold, the main runner and the branch runners are disposed in a Y-shape, and the branch runners are disposed in a V-shape, and when a portion where molten metal that has passed through the main runner hits and divides into the branch runners is referred to as a V-shaped portion, a void extending across a valley bottom of the V-shaped portion and connecting inlets of the branch runners is provided.

The invention according to a second aspect is, preferably, the casting mold according to the first aspect, in which in a cross-section taken along a plane orthogonal to a longitudinal axis of the void, there are a valley bottom line defining the valley bottom of the V-shaped portion, a first void contour line connected to one end of the valley bottom line, and a second void contour line connected to the other end of the valley bottom line of the V-shaped portion, and a total of two voids are provided at both ends of the valley bottom line of the V-shaped portion, with one void at each end of the valley bottom line.

Effect of the Invention

In the invention according to the first aspect, the void is provided at the V-shaped portion inside the casting mold.

Product portions are casted by the cavities, a plan portion is casted by the main runner and the branch runners, and a V-shaped plan portion is formed at the V-shaped portion. At this time, a rib having a bridge shape is formed at the V-shaped plan portion by the void. The rib exhibits a reinforcing effect, and prevents breakage of the plan portion.

Due to the reinforcing effect of the rib, even when a central portion of the plan portion is in an unsolidified state, the strength of the plan portion is ensured, and a casting can be satisfactorily removed from the casting mold.

As a result, the invention provides a technique capable of achieving shortening of the casting cycle time in the multi-cavity casting mold including the V-shaped portion at the plan portion.

In the invention according to the second aspect, a total of two voids are provided at both ends of the valley bottom line of the V-shaped portion, with one void at each end of the valley bottom line.

The valley bottom line corresponds to an upper surface of the main runner. The plane orthogonal to the valley bottom line corresponds to a side surface of the main runner.

In the main runner, the molten metal cools from the upper surface and the side surfaces by the casting mold. Since the voids are provided at intersecting portions between the upper surface and the side surfaces (including the vicinities of the intersecting portions), the molten metal with which the voids are filled cools quickly, and becomes ribs having high strength.

Namely, two voids are provided, and two ribs having high strength are formed at the V-shaped plan portion. Even when the casting cycle time is further shortened, the casting can be removed from the casting mold while the plan portion remains intact.

MODE(S) FOR CARRYING OUT THE INVENTION

An embodiment of the invention will be described below based on the accompanying drawings.

Embodiment

[Casting Equipment]

Figure 1:
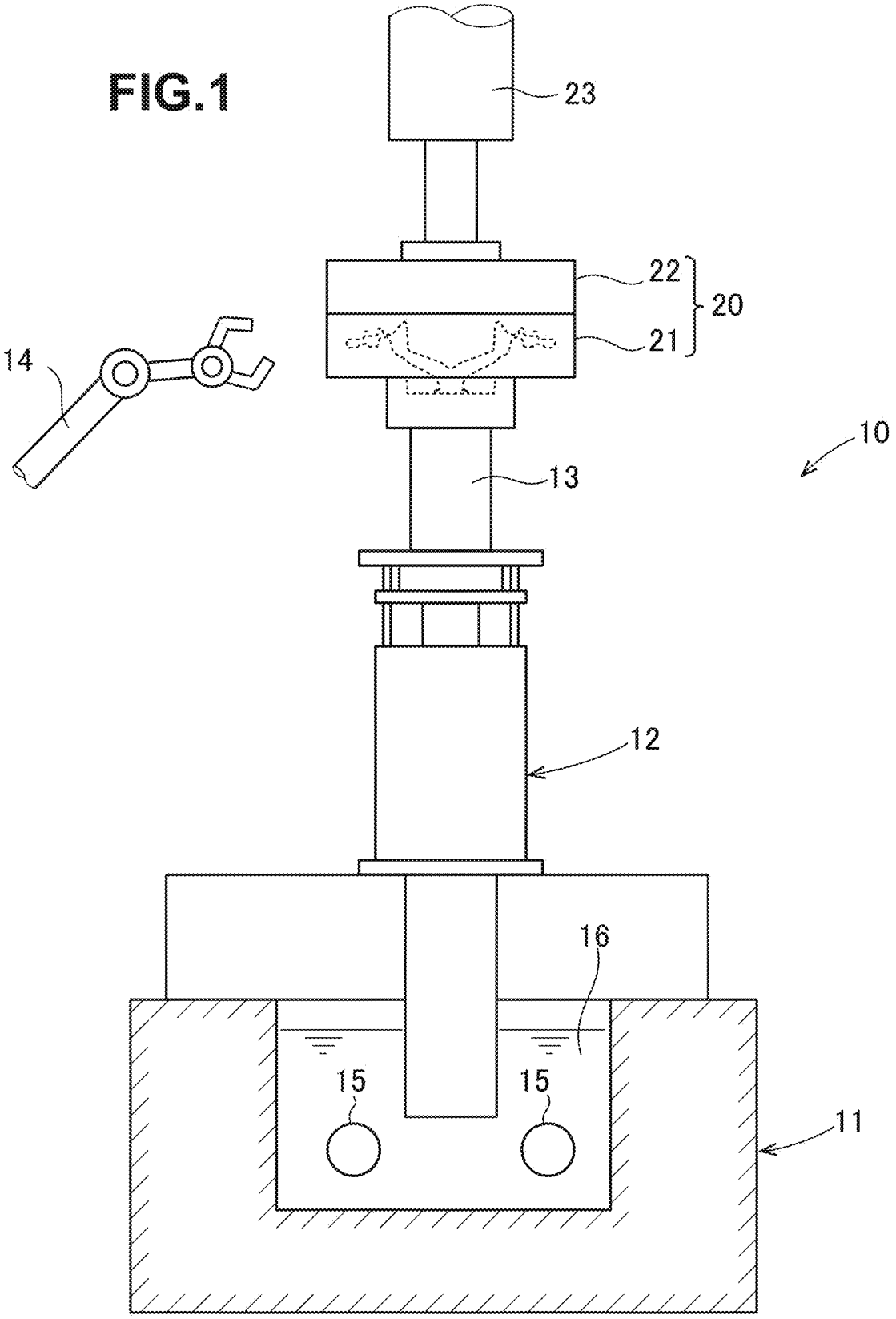
FIG. 1 is a view illustrating the principle of a casting equipment.

As illustrated in FIG. 1, a casting equipment 10 includes, for example, a holding furnace 11, an electromagnetic pump 12, a stalk 13, a casting mold 20, and a product removal robot 14.

The holding furnace 11 is a furnace that includes a heater 15, and that stores molten metal 16 of aluminum.

The electromagnetic pump 12 is a device that pumps up the molten metal 16, pressurizes the molten metal 16, and sends the molten metal 16 to the casting mold 20.

The casting mold 20 will be described in detail later; however, the casting mold 20 includes, for example, a fixed mold 21 and a movable mold 22 placed on the fixed mold 21.

The fixed mold 21 is referred to as a fixed mold since the fixed mold 21 is stationary on the stalk 13.

The movable mold 22 is referred to as a movable mold since the movable mold 22 is raised and lowered by a cylinder 23.

The product removal robot 14 is a device that moves under the movable mold 22 to remove a casting from the movable mold 22.

Incidentally, the casting equipment 10 may be a low-pressure casting equipment or a die-casting equipment, and is not limited to equipment using the electromagnetic pump 12.

[Casting Mold]

Figure 2:
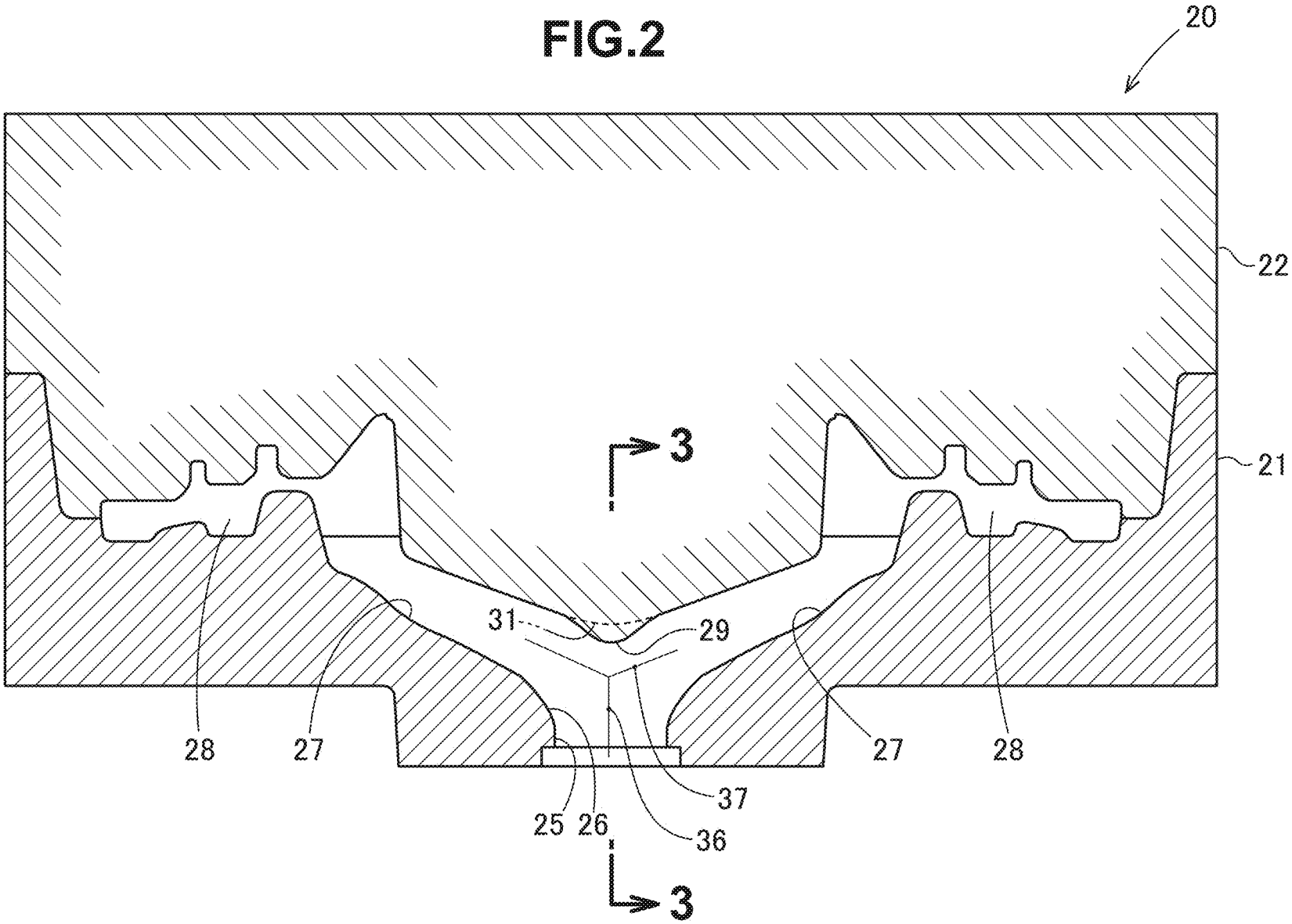
FIG. 2 is a cross-sectional view of a casting mold according to the invention.

As illustrated in FIG. 2, the casting mold 20 includes, for example, the fixed mold 21 and the movable mold 22. The casting mold 20 is a multi-cavity (two in this example) casting mold including a gate 25; a main runner 26 having a thick columnar shape and extending from the gate 25; a plurality (two in this example) of branch runners 27 branching off from the main runner 26; and cavities 28 provided at respective ends of the branch runners 27. Incidentally, the casting mold 20 may be a complex mold formed by adding an intermediate mold and/or a slide mold to the fixed mold 21 and the movable mold 22.

[V-Shaped Portion]

The main runner 26 and the plurality of branch runners 27 are disposed along a Y-shape 36. When the Y-shape 36 is divided into an upper "V" and a lower "I", the upper "V" is referred to as a V-shape 37. Thereupon, the plurality of branch runners 27 are disposed along the V-shape 37. Namely, in a cross-section of the casting mold 20, the main runner 26 and the branch runners 27 are disposed in a Y-shape, and the branch runners 27 are disposed in a V-shape.

Incidentally, the Y-shape 36 may be a neat Y-shape that is symmetrical about a vertical central axis, or may be an asymmetrical and irregular Y-shape. Similarly, the V-shape 37 may be a neat V-shape that is symmetrical about a vertical central axis, or may be an irregular V-shape.

The molten metal (FIG. 1, reference numeral 16) passes through the gate 25, rises up the main runner 26, hits a portion of the movable mold 22, the portion protruding downward, and divides. A portion where the molten metal that has passed through the main runner 26 hits and divides into the branch runners 27 is referred to as a V-shaped portion 29.

[Void]

A void 31 is attached to the V-shaped portion 29 to extend across a valley bottom of the V-shaped portion 29. The void 31 is connected to inlets of the branch runners 27.

Namely, the void 31 extending across the valley bottom of the V-shaped portion 29 and connecting the inlets of the branch runners 27 is provided in the V-shaped portion 29.

Figure 3:
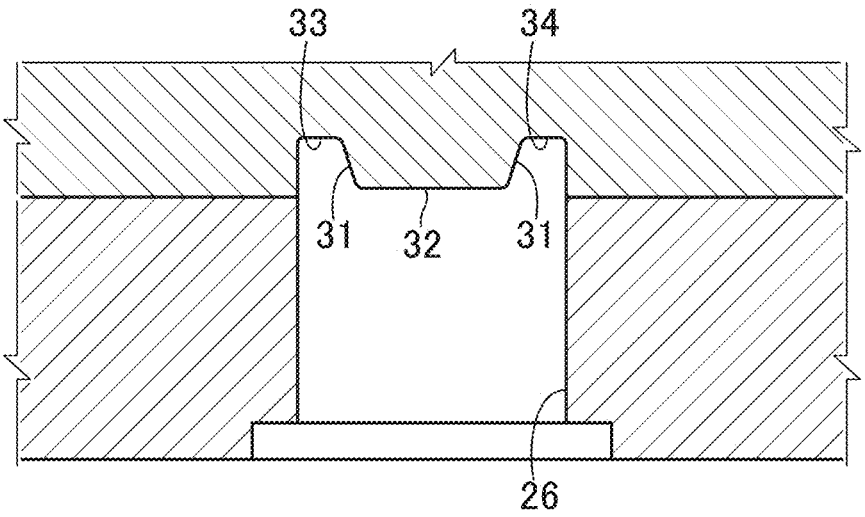
FIG. 3 is a cross-sectional view taken along line 3-3 in FIG. 2.

A cross-sectional view taken along line 3-3 in FIG. 2 is illustrated in FIG. 3.

As illustrated in FIG. 3, two voids 31 are provided. In FIG. 3, an axis extending from the front to the back of the drawing (an axis extending from the left to the right in FIG. 2) is referred to as a longitudinal axis of the voids 31.

FIG. 3 is a cross-sectional view taken along a plane orthogonal to the longitudinal axis of the voids 31.

In this cross-section, there are a valley bottom line 32 that defines the valley bottom, a first void contour line 33 connected to one end of the valley bottom line 32, and a second void contour line 34 connected to the other end of the valley bottom line 32.

Then, one void 31 is formed by the first void contour line 33, and the other void 31 is formed by the second void contour line 34.

As a result, a total of two voids 31 are provided at both ends of the valley bottom line 32, with one void 31 at each end of the valley bottom line 32.

In FIG. 2, the molten metal (FIG. 1, reference numeral 16) flows in order of the gate 25, the main runner 26, the V-shaped portion 29, the voids 31, and the branch runners 27, and the cavities 28 are filled with the molten metal. Then, the molten metal cools and solidifies due to the cooling effect of the mold 20.

First, the molten metal in the cavities 28 solidifies, next, the molten metal in the branch runners 27 solidifies, and finally, the molten metal in the main runner 26 solidifies.

In the invention, the casting cycle time is shortened by opening the casting mold 20 when the molten metal in the cavities 28 is completely solidified and the molten metal in the main runner 26 is incompletely solidified (semi-solidified).

The casting is separated from the fixed mold 21 in a state where the casting is attached to the movable mold 22. During this time, solidification of the molten metal in the main runner 26 progresses.

Next, the casting is removed from the movable mold 22. The removed casting is illustrated in FIG. 4.

[Casting]

Figure 4:
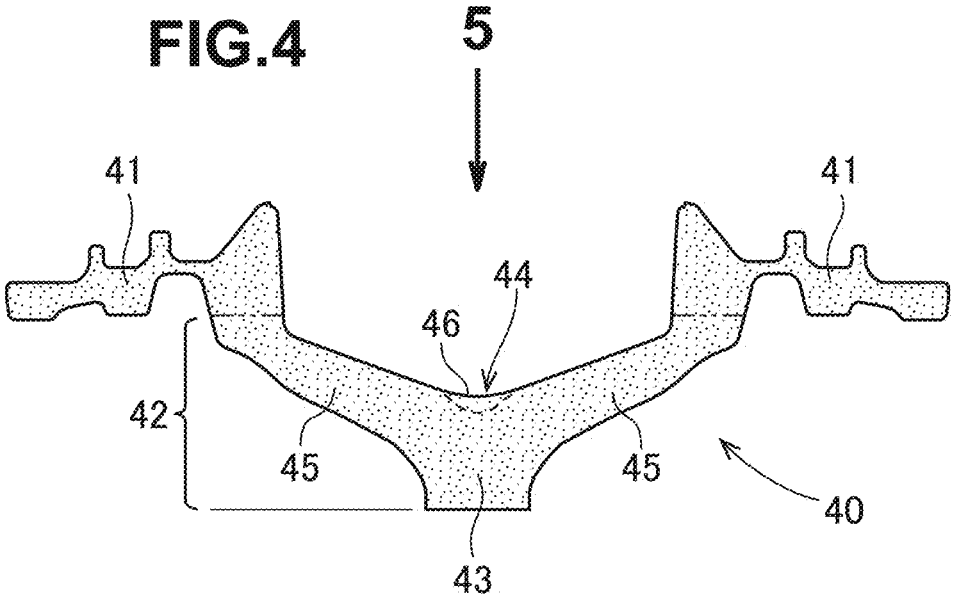
FIG. 4 is an outline view of a casting.

As illustrated in FIG. 4, an obtained casting 40 includes left and right product portions 41 and a plan portion 42 other than the left and right product portions 41.

The product portions 41 are, for example, a left steering knuckle and a right steering knuckle made of an aluminum alloy. However, the product portions 41 are not limited to the steering knuckles.

The plan portion 42 includes a main plan portion 43 having a large diameter; a V-shaped plan portion 44 at an upper end of the main plan portion 43; and branch plan portions 45 branching off from the V-shaped plan portion 44 to the left and right.

[Rib]

Figure 5:
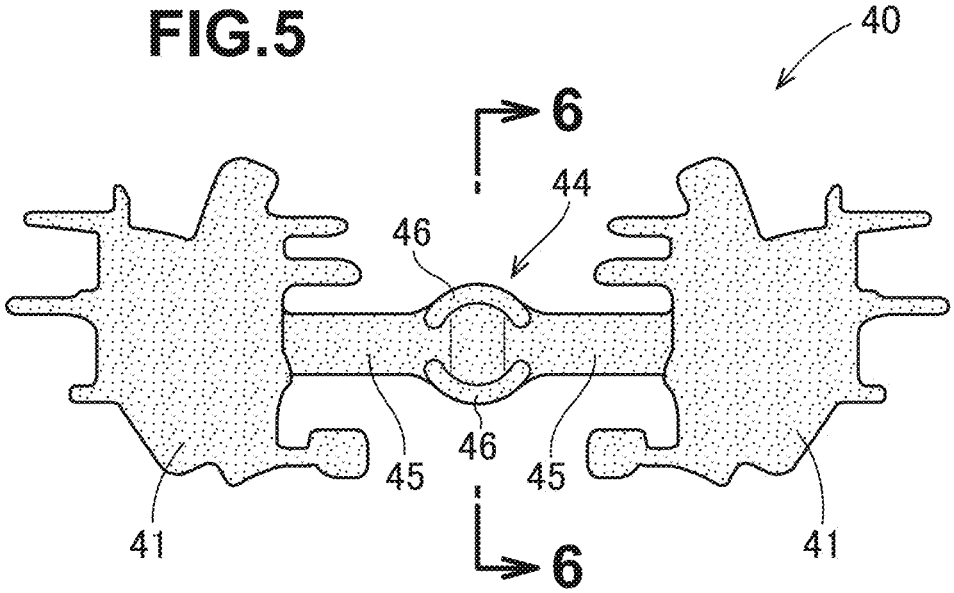
FIG. 5 is a view when seen from arrow 5 in FIG. 4.

A view when seen from arrow 5 in FIG. 4 is illustrated in FIG. 5.

As illustrated in FIG. 5, two ribs 46 are formed at the V-shaped plan portion 44.

As illustrated in FIG. 4, the ribs 46 serve as bridges connecting the left branch plan portion 45 and the right branch plan portion 45.

Figure 6:
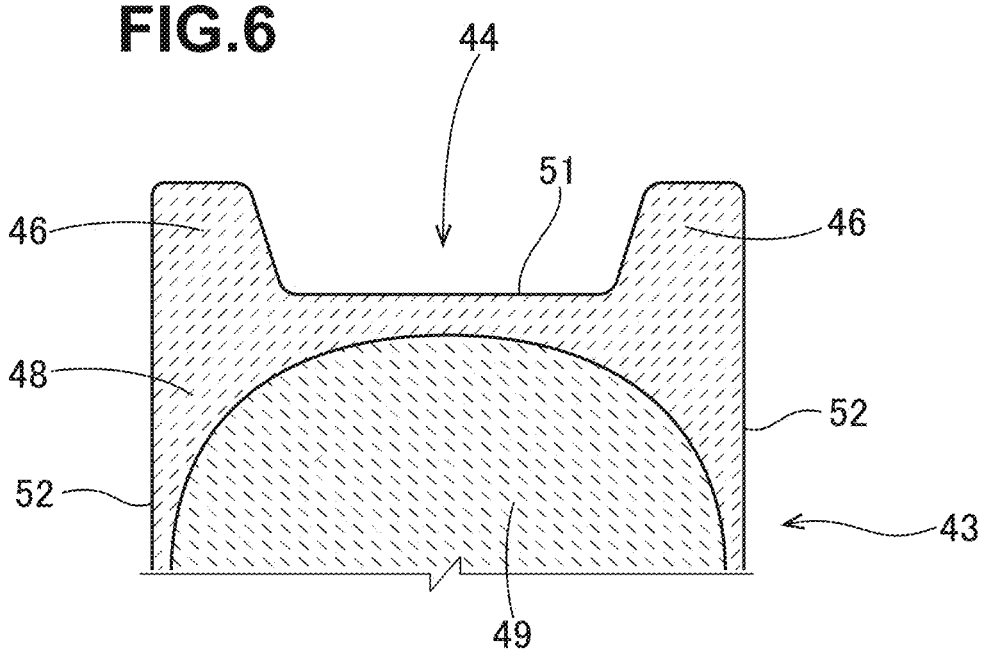
FIG. 6 is a cross-sectional view taken along line 6-6 in FIG. 5.

A cross-sectional view taken along line 6-6 in FIG. 5 is illustrated in FIG. 6.

As illustrated in FIG. 6, when a cross-section of the V-shaped plan portion 44 is observed, a gray cross-sectional portion 48 and a white cross-sectional portion 49 appear. The gray cross-sectional portion 48 cools at a sufficient speed. When the molten metal cools rapidly, the molten metal becomes chilled. Chilled structure has high strength.

Namely, the gray cross-sectional portion 48 has high strength.

Meanwhile, the white cross-sectional portion 49 is an unsolidified fracture surface, and has low strength.

The ribs 46 belong to the gray cross-sectional portion 48, and have high strength.

When the movable mold 22 is opened upward from the fixed mold 21 illustrated in FIG. 2, it is necessary to pull out the main plan portion (FIG. 4, reference numeral 43) from the main runner 26. When the pulling-out is performed, a large force is applied to the V-shaped plan portion (FIG. 4, reference numeral 44).

However, in the invention, as illustrated in FIG. 4, the ribs 46 having a bridge shape are provided across the V-shaped plan portion 44, and since the ribs 46 reinforce the V-shaped plan portion 44, the V-shaped plan portion 44 does not break. As a result, when the main plan portion 43 is semi-solidified (incompletely solidified), the casting mold can be opened, and the casting cycle time can be shortened.

Modification examples according to the invention will be described based on FIG. 7.

Figure 7A:
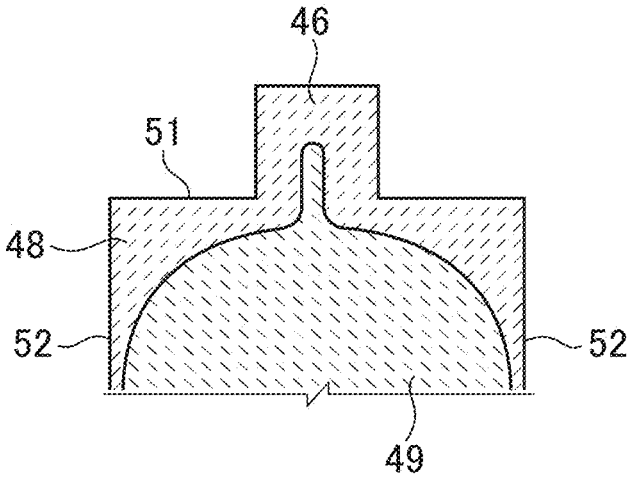
FIG. 7(*a*) to FIG. 7(*c*) are cross-sectional views for describing modification examples.
Figure 7B:
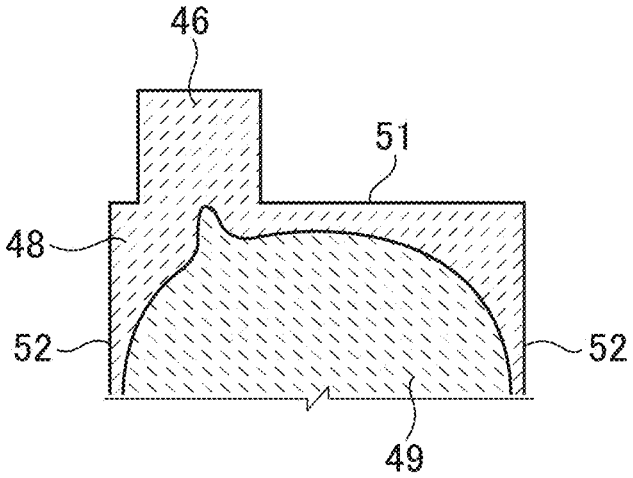
Figure 7C:
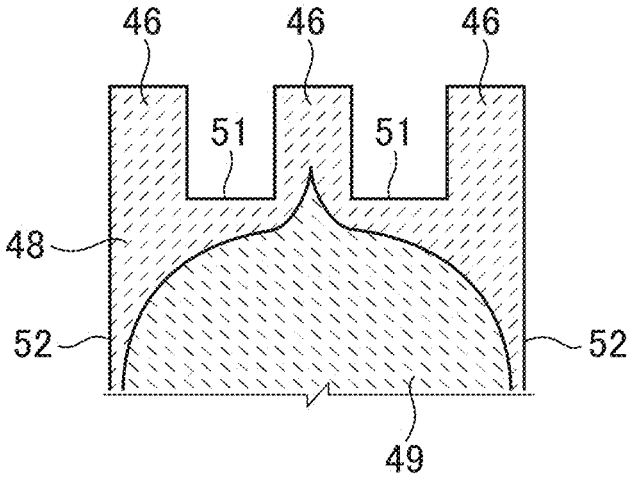
Figure 8:
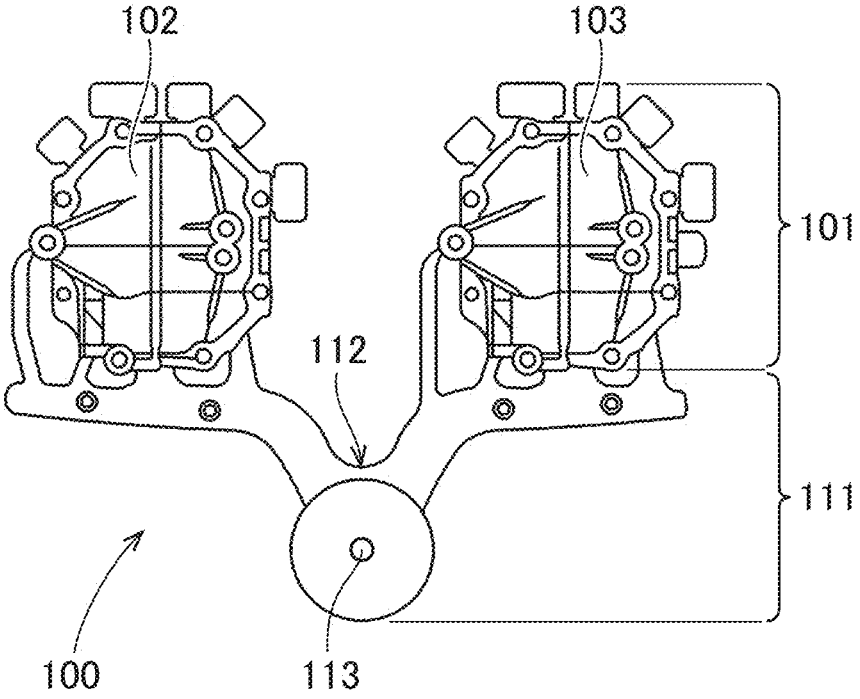
(PRIOR ART) FIG.8
FIG. 8 is an outline view of a casting casted by the conventional art.

As illustrated in FIG. 7(*a*), one rib 46 may be provided at the center of an upper surface 51.

Alternatively, as illustrated in FIG. 7(*b*), one rib 46 may be provided at one end of the upper surface 51.

Alternatively, as illustrated in FIG. 7(*c*), three or four or more ribs 46 may be provided.

However, cooling of the molten metal progresses from the upper surface 51 and side surfaces 52 toward the center of the molten metal.

In the case of FIG. 7(*b*), since the rib 46 is formed at a portion where the upper surface 51 and the side surface 52 intersect each other (namely, a portion that cools from two surfaces), the rib 46 cools at a high speed, and has high strength.

In addition, in FIG. 6 as well, since the ribs 46 are formed at portions where the upper surface 51 and the side surfaces 52 intersect each other (portions that cool from two surfaces), the ribs 46 cool at a high speed, and have high strength.

From the viewpoint of ensuring strength and balance, the configuration in FIG. 6 is more desirable than those in FIG. 7(*a*) to FIG. 7(*c*).

Incidentally, the rib 46 may have a rectangular cross-section as illustrated in FIG. 7(*a*) or a trapezoidal cross-section protruding upward as illustrated in FIG. 6, or may have a triangular cross-section, a semi-circular cross-section protruding upward, or a semi-elliptical cross-section, and the cross-sectional shape is not limited to the embodiment.

INDUSTRIAL APPLICABILITY

The invention is suitable for a multi-cavity casting mold.

EXPLANATIONS OF LETTERS OR NUMERALS

16 MOLTEN METAL
20 CASTING MOLD
25 GATE
26 MAIN RUNNER
27 BRANCH RUNNER
28 CAVITY
29 V-SHAPED PORTION
31 VOID
32 VALLEY BOTTOM LINE
33 FIRST VOID CONTOUR LINE
34 SECOND VOID CONTOUR LINE
36 Y-SHAPE
37 V-SHAPE
40 CASTING
41 PRODUCT PORTION
42 PLAN PORTION
44 V-SHAPED PLAN PORTION
46 RIB

The invention claimed is:

1. A casting mold that is a multi-cavity casting mold, the casting mold comprising:

a gate;

a main runner extending from the gate;

a plurality of branch runners branching off from the main runner; and cavities provided at respective ends of the branch runners, wherein in a cross-section of the casting mold, the main runner and the branch runners are disposed in a Y-shape, and the branch runners are disposed in a V-shape, a portion of the casting mold where molten metal that has passed through the main runner hits and divides into the branch runners is V-shaped, and a void is provided which extends across a valley bottom of the V-shaped portion and connects inlets of the branch runners.

2. The casting mold according to claim 1, wherein in a cross-section taken along a plane orthogonal to a longitudinal axis of the void, there are a valley bottom surface which defines the valley bottom of the V-shaped portion, a first void contour surface connected to one end of the valley bottom surface, and a second void contour surface connected to the other end of the valley bottom surface of the V-shaped portion, and the void includes two portions provided at both ends of the valley bottom surface of the V-shaped portion, with one void at each end of the valley bottom surface.

* * * * *